US007533425B2

(12) United States Patent
Monti et al.

(10) Patent No.: US 7,533,425 B2
(45) Date of Patent: May 19, 2009

(54) JUVENILE BATHTUB

(75) Inventors: Steven Monti, Cumberland, RI (US); Yves Michel, Randolph, MA (US); Andrew W. Marsden, Hingham, MA (US)

(73) Assignee: Cosco Management, Inc., Wilmington, DE (US)

( * ) Notice: Subject to any disclaimer, the term of this patent is extended or adjusted under 35 U.S.C. 154(b) by 75 days.

(21) Appl. No.: 11/531,647

(22) Filed: Sep. 13, 2006

(65) Prior Publication Data

US 2007/0220669 A1 Sep. 27, 2007

Related U.S. Application Data

(60) Provisional application No. 60/717,021, filed on Sep. 14, 2005.

(51) Int. Cl.
*A47K 3/024* (2006.01)

(52) U.S. Cl. ..... 4/572.1; 4/590; 4/628

(58) Field of Classification Search ..... 4/571.1, 4/573.1, 578.1, 579, 641, 642, 572.2, 590, 4/628, 572.1
See application file for complete search history.

(56) References Cited

U.S. PATENT DOCUMENTS 3,995,331 A * 12/1976 Fotre et al. ..... 4/572.1
D299,741 S * 2/1989 Thom ..... D23/278
4,881,231 A * 11/1989 Jain ..... 372/32
4,881,281 A * 11/1989 Lavoine et al. ..... 4/572.1
5,092,001 A * 3/1992 Ross et al. ..... 4/572.1
5,181,284 A * 1/1993 Raphael et al. ..... 4/572.1
5,276,926 A 1/1994 Lopez
5,588,158 A 12/1996 Poulson et al.
5,599,063 A * 2/1997 Lister et al. ..... 297/325
5,636,391 A * 6/1997 Greene, III ..... 4/420.3
5,974,601 A * 11/1999 Drane et al. ..... 4/539
D419,785 S * 2/2000 Conforti et al. ..... D6/333
6,112,343 A * 9/2000 Dixon ..... 4/572.1
6,253,392 B1 7/2001 Conforti et al.
6,415,460 B1 * 7/2002 Rossman et al. ..... 4/572.1
6,578,209 B2 6/2003 Lopes et al.
6,785,917 B1 9/2004 Bryant
7,065,805 B1 * 6/2006 Sundberg ..... 4/572.1
D538,897 S * 3/2007 Erli ..... D23/278
7,305,724 B2 * 12/2007 Rozental et al. ..... 4/665
7,430,769 B2 * 10/2008 Davis ..... 4/572.1

* cited by examiner

*Primary Examiner*—John Rivell
*Assistant Examiner*—Macade Brown
(74) *Attorney, Agent, or Firm*—Barnes & Thornburg LLP

(57) ABSTRACT

A juvenile bathtub includes a basin and a nest formed as a seat for supporting a juvenile in the basin. The basin includes a top surface and a bottom surface and a cavity to retain a pool of bathing water. The nest is mounted for movement in the basin and includes lower and upper sections and further includes a lowered position and a raised position within and relative to the basin.

20 Claims, 2 Drawing Sheets

JUVENILE BATHTUB

This application claims priority under 35 U.S.C. § 119(e) to U.S. Provisional Application Ser. No. 60/717,021, filed Sep. 14, 2005, which is expressly incorporated by reference herein.

BACKGROUND

The present disclosure relates to bathing apparatus, and particularly to a juvenile bathtub. More particularly, the present disclosure relates to a bathtub adapted to be used by infants and very young children.

SUMMARY

A juvenile bathtub in accordance with the present disclosure comprises a basin and a juvenile-support nest mounted for movement in the basin to move a juvenile placed on the juvenile-support nest relative to a pool of bath water stored in the basin. In illustrative embodiments, the juvenile-support nest includes a carrier and a carrier-suspension frame interposed between the basin and the carrier and configured to support the carrier as the juvenile-support nest moves between two or more selected positions in the base.

Once the basin is filled with a certain volume of water, a caregiver can elect to move the juvenile-support nest relative to the basin to assume either a "lowered" position or a "raised" position. A juvenile seated in the juvenile-support nest typically will be exposed to more water in the basin in the lowered position as compared to the raised position.

Additional features of the present disclosure will become apparent to those skilled in the art upon consideration of the following detailed description of illustrative embodiments of the disclosure exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
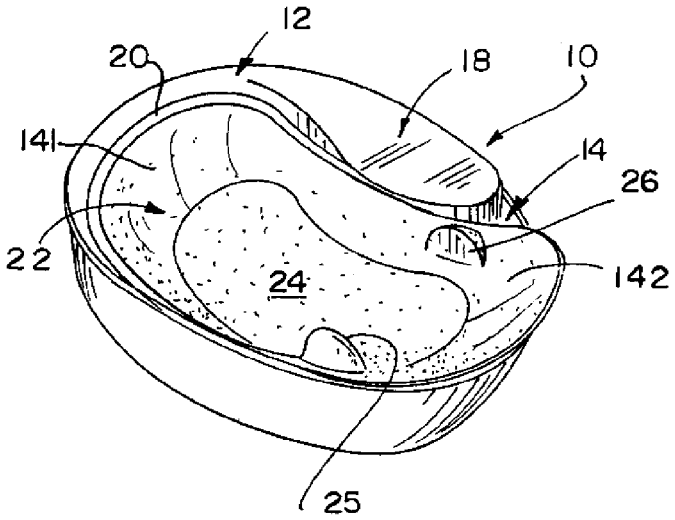
FIG. 1 is a perspective view of a juvenile bathtub in accordance with a first embodiment of the present disclosure showing a juvenile-support nest located in a lowered position in a basin.
Figure 2:
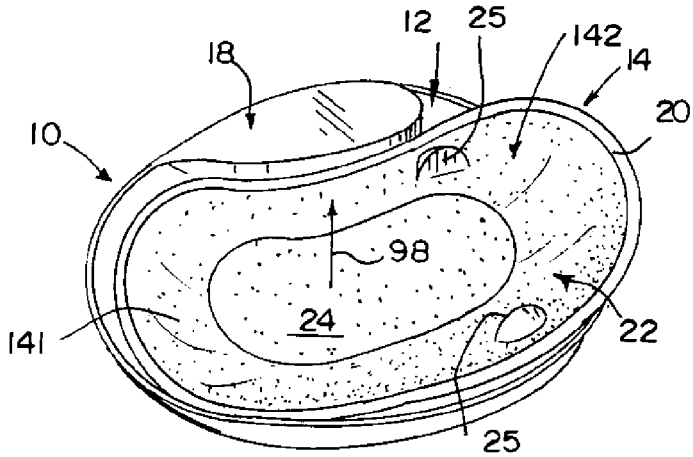
FIG. 2 is another perspective view of the juvenile bathtub of FIG. 1 showing a storage tray formed in the basin and arranged to lie alongside the juvenile-support nest.
Figure 3:
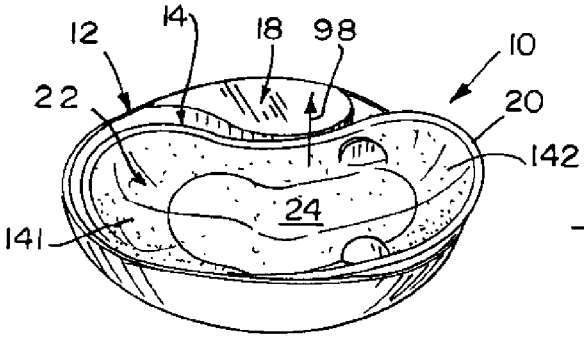
FIG. 3 is a view similar to FIG. 2.

A juvenile bathtub 10 in accordance with a first embodiment of the present disclosure includes a basin 12 and a juvenile-support nest 14 as shown, for example, in FIGS. 1 and 2. Juvenile-support nest 14 is mounted for movement in basin 12 between a "lowered" position shown, for example, in FIG. 3 and a "raised" position shown, for example, in FIG. 4. Another juvenile bathtub 110 is shown in FIG. 5.

Basin 12 is configured to retain a pool (not shown) of bathing water for a juvenile (not shown) supported on movable nest 14. In the lowered position, such a juvenile is exposed to more water in the pool of bathing water than in the raised position of movable nest 14.

Figure 4:
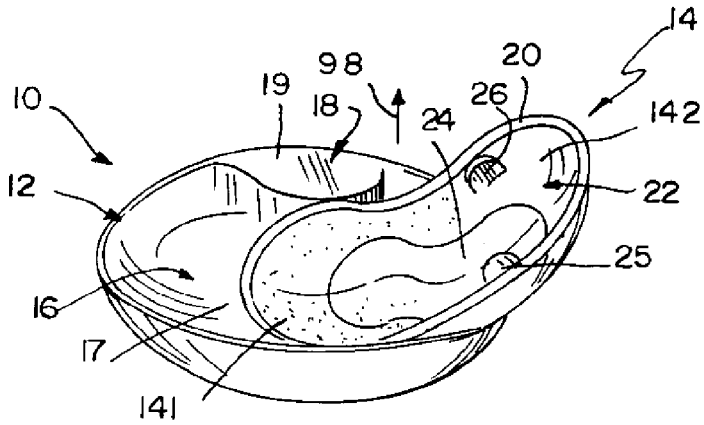
FIG. 4 is a view similar to FIG. 3 showing movement of the juvenile-support nest relative to the basin to assume a raised position in the basin.
Figure 5:
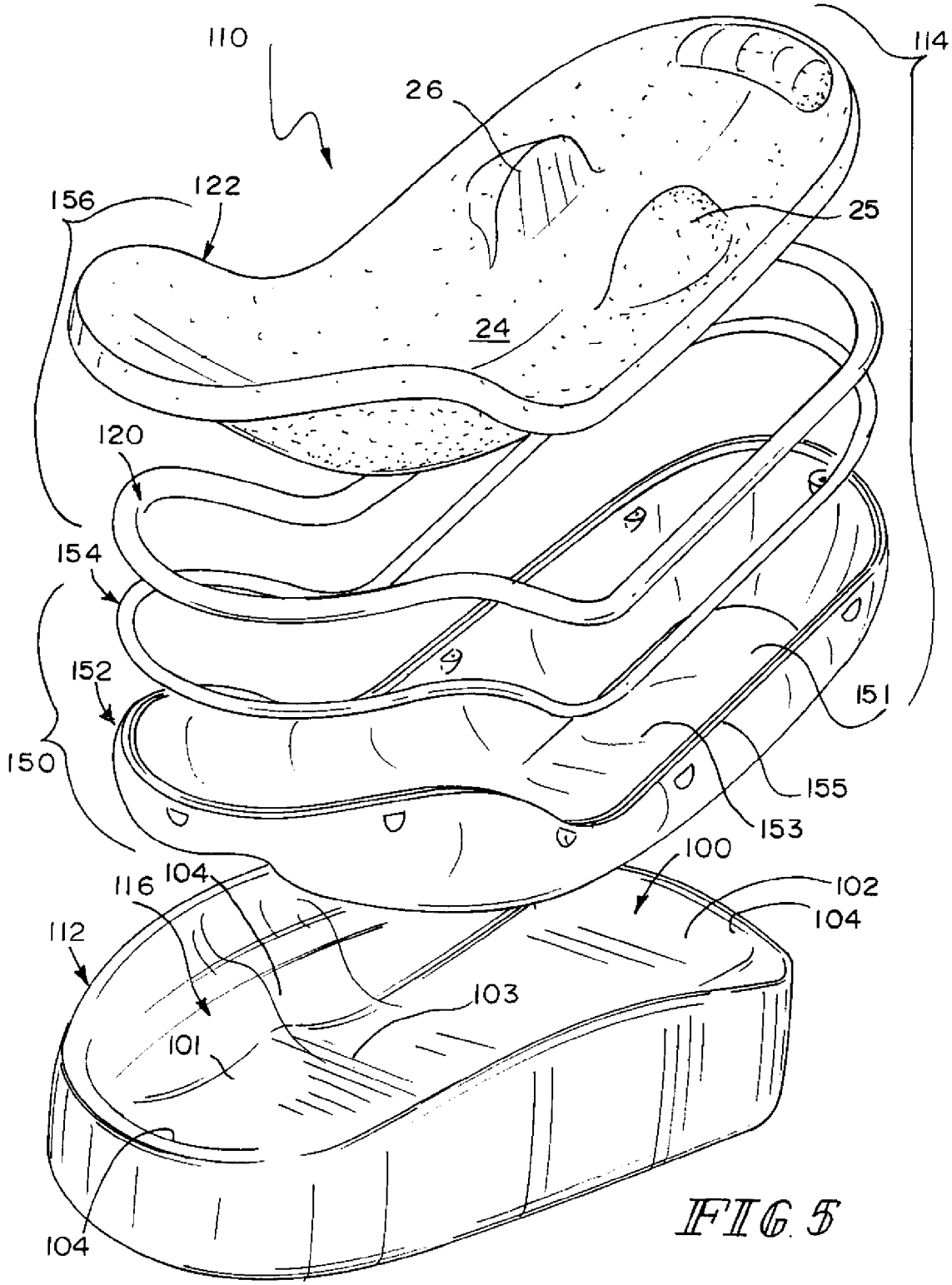
FIG. 5 is an exploded perspective view of a juvenile bathtub in accordance with a second embodiment of the present disclosure showing from (from bottom to top) a foundation, a reservoir, and a reservoir frame (cooperating with the reservoir and foundation to define a basin) and a carrier frame and a carrier (cooperating with the underlying carrier frame to define a juvenile-support nest).

In an illustrative embodiment, basin 12 is formed to include a large first cavity 16 and a smaller second cavity 18 alongside first cavity 16 as shown, for example, in FIG. 4. First cavity 16 is sized and configured to retain the pool of bathing water and all or a portion of movable nest 14. Second cavity 18 is sized to provide a rinsing pitcher storage tray or other suitable accessory storage space. In the illustrated embodiment, first cavity 16 has a floor 17 that is located at a lower elevation than floor 19 of second cavity 18.

Movable nest 14 comprises a perimeter frame 20 and a carrier 22 coupled to perimeter frame 20 as shown, for example, in FIGS. 1 and 2. Perimeter frame 20 is made, for example, of a rigid and sturdy material. Carrier 22 is sized to support a juvenile (e.g., newborn to about age two) in a supine position during a bathing activity.

Carrier 22 is made of a soft but supportive material such as neoprene. Soft pads are integrated into the body of carrier 22 to provide suitable positioning and support for a child. The soft and stretchy material used to make carrier 22 supports the child relative to frame 20 like a hammock, keeps the child partly suspended above bath water in first cavity 16 of basin 12, and is porous to allow for drainage when rinsing a child seated in carrier 22. Carrier 22 includes an upwardly facing surface 24 and a pair of molded-in arm posts 25, 26 extending upwardly from surface 24 as shown, for example, in FIGS. 1-4 and functioning to help hold a child in a preferred place on upwardly facing surface 24 of carrier 22.

Juvenile-support nest 14 is configured to include lower and upper sections 141, 142 and is mounted for movement in first cavity 18 of basin 12 between a lowered position in basin 12 wherein both of lower and upper sections 141, 142 are located substantially in first cavity 16 and exposed to bathing water retained in first cavity 16 and a raised position in basin 12 wherein only lower section 141 is located in first cavity 16 and exposed to bathing water retained in first cavity 16. Lower section 141 is configured to provide means for receiving legs and hips of a juvenile (not shown) lying in a supine position on an upwardly facing surface of lower and upper sections 141, 142 and upper section 142 is configured to provide a backrest for such ajuvenile. Upper section 142 is formed to include a spaced-apart pair of arm posts 25, 26 extending upwardly from the backrest in a direction 98 away from basin 12 underlying juvenile-support nest 14 to provide means for holding a juvenile in place on the upwardly facing surface of upper and lower sections 141, 142.

Movable nest 14 can be set in basin 12 in multiple positions to allow caregivers to bathe children at different ages up to about two years of age. One of the raised positions is illustrated in FIG. 4 and other positions in basin 12 are within the scope of the present disclosure.

It is contemplated that movable nest 14 can be used in basin 12, in a sink (not shown), or on a counter (not shown). One or more legs (not shown) would be appended to nest 14 to allow nest 14 to rest in a stable position on such a counter or table.

A juvenile bathtub 110 in accordance with another embodiment of the present disclosure is shown in FIG. 5. In this embodiment, bathtub 110 includes a basin 112 and a movable juvenile-support nest 114.

Basin 112 is formed to include a first cavity 116 and a floor 100 having a first floor section 101, a second floor section 102, a raised ridge 103 between the first and second floor sections 101, 102, and a perimeter side wall 104 surrounding and cooperating with first and second floor sections 101, 102 and ridge 103 to define first cavity 116.

Juvenile-support nest 114 comprises a carrier support 150 including a foundation 152 and a companion perimeter frame 154 and a foundation cover 156 including a carrier 122 and a companion perimeter frame 120 as shown, for example, in FIG. 5. Foundation 152 is configured to fit into first cavity 116 of basin 112 and rest on either or both of first and second floor sections 101, 102. Foundation 152 includes a side wall 151 formed to include a central opening 153 located to communicate with cavity 116.

Foundation cover 156 includes perimeter frame 120 and carrier 122 as shown, for example, in FIG. 5. Perimeter frame 154 is configured to mate with edge 155 of side wall 151. Carrier 122 is similar to carrier 22 and is coupled to a perimeter frame 120 that is similar to frame 20. Carrier 122 is porous to allow water collecting in carrier 122 to pass through central opening 153 formed in foundation 152 into a pool of water collecting in first cavity 116 in basin 112.

The invention claimed is:

1. A juvenile bathtub comprising a basin including a top surface and a bottom surface, the basin formed to include a first cavity sized to retain a pool of bathing water, a juvenile-support nest including a lower section and an upper section, each section including an upper surface and a lower surface, and the nest having a lowered position and a raised position within and relative to the basin, and wherein a portion of the top surface of the basin and a portion of the lower surface of the nest are complementarily shaped and engageable with each other for movement of the entire juvenile support nest relative to the basin in the first cavity between the lowered position in the basin wherein both of the lower and upper sections are located substantially in the first cavity and exposed to bathing water retained in the first cavity and the raised position in the basin wherein only the lower section is located in the first cavity and exposed to bathing water retained in the first cavity.

2. The bathtub of claim 1, wherein the lower section is configured to provide means for receiving legs and hips of a juvenile lying in a supine position on an upwardly facing surface of the upper and lower sections and the upper section is configured to provide a backrest for such a juvenile.

3. The bathtub of claim 2, wherein the upper section is formed to include a spaced-apart pair of arm posts extending upwardly from the backrest in a direction away from the basin underlying the juvenile-support nest to provide means for holding a juvenile in place on the upwardly facing surface of the upper and lower sections.

4. The bathtub of claim 1, wherein the basin is formed to include a second cavity located alongside the first cavity and configured to provide a storage receptacle.

5. The bathtub of claim 4, wherein the second cavity has a floor and the first cavity has a floor that is located at a lower elevation than the floor of the second cavity.

6. The bathtub of claim 1, wherein the juvenile-support nest includes a perimeter frame and a carrier coupled to the perimeter frame.

7. The bathtub of claim 6, wherein the carrier is porous to allow water received in the carrier to drain through the carrier into the first cavity formed in the basin while the carrier is coupled to the perimeter frame and the perimeter frame mates with the basin.

8. The bathtub of claim 6, wherein the carrier is made of a soft and supportive material and is configured to provide means for supporting a juvenile in a supine position during a bathing activity.

9. The bathtub of claim 8, wherein the soft and support material forming the carrier is porous to allow water received in the carrier to drain through the carrier into the first cavity formed in the basin while the carrier is coupled to the perimeter frame and the perimeter frame mates with the basin.

10. The bathtub of claim 1, wherein the juvenile-support nest includes a foundation formed to include a central opening communicating with the first cavity and a foundation cover mounted on the foundation and configured to include a carrier.

11. The bathtub of claim 10, wherein the carrier is made of a soft and supportive material and is configured to provide means for supporting a juvenile in a supine position during a bathing activity.

12. The bathtub of claim 11, wherein the soft and support material forming the carrier is porous to allow water received in the carrier to drain through the carrier into the first cavity formed in the basin while the carrier is coupled to the perimeter frame and the perimeter frame mates with the basin.

13. The bathtub of claim 10, wherein the carrier includes the lower and upper sections and wherein the lower section is configured to provide means for receiving legs and hips of a juvenile lying in a supine position on an upwardly facing surface of the upper and lower sections and the upper section is configured to provide a backrest for such juvenile.

14. The bathtub of claim 13, wherein the upper section is formed to include a spaced-apart pair of arm posts extending upwardly from the backrest in a direction away from the basin underlying the juvenile-support nest to provide means for holding a juvenile in place on the upwardly facing surface of the upper and lower sections.

15. A juvenile bathtub comprising a basin including a top surface and a bottom surface, the basin formed to include a first cavity sized to retain a pool of bathing water, a juvenile-support nest including a lower section and an upper section, each section including an upper surface and a lower surface and the nest having a lowered position and a raised position within and relative to the basin, and wherein the top surface of the basin and the lower surface of the nest are complementarily shaped and engageable with each other for movement of the entire juvenile support nest relative to the basin between a lowered position in the basin wherein both of the lower and upper sections are located substantially in the first cavity and a raised position wherein only the upper section is located substantially above the first cavity and not exposed to the pool of bathing water retained in the first cavity.

16. The bathtub of claim 15, wherein the movable juvenile-support nest provides means for receiving legs and hips of a juvenile lying in a supine position on an upwardly facing surface of the upper and lower sections and the upper section is configured to provide a backrest for the juvenile.

17. A juvenile bathtub comprising a basin formed to include a first cavity having a floor and first and second floor sections and a moveable juvenile-support nest having a raised and a lowered position within and relative to the basin, the movable juvenile-support nest including a carrier resting on the basin and a carrier support interposed between the basin and the carrier, the carrier support supporting the carrier as the entire movable juvenile-support nest moves between the lowered position and the raised position, the raised position having a portion of the movable juvenile-support nest extending above a side wall of the basin.

18. The bathtub of claim 17, wherein the carrier support includes a foundation, a perimeter frame and a foundation cover, the foundation fitting into the first cavity and resting on at least one of the floor sections.

19. The bathtub of claim 18, wherein the foundation cover mates with and fits over the foundation to provide means for receiving and holding a juvenile in place on an upwardly facing surface of the carrier.

20. A juvenile bathtub comprising a basin including an upper surface having concave-shaped first and second sections and a raised edge dividing and located between the concave-shaped first and second sections, the raised edge being higher than a lowest point of each of the concave-shaped first and second sections, a nest configured as a seat having a bottom portion and a back portion to receive, respectively, a bottom and a rear end of a juvenile, the nest having a lowered position and a raised position within and relative to the basin, and wherein the bottom portion is convex-shaped and complementarily engages the concave-shaped first section to retain the nest in the lowered position and the bottom portion alternatively engages the concave-shaped second section to retain the nest in the raised position.

* * * * *